US010731934B2

(12) United States Patent
Song et al.

(10) Patent No.: US 10,731,934 B2
(45) Date of Patent: Aug. 4, 2020

(54) FIREARM RECEIVER AND A METHOD OF MANUFACTURING IT

(71) Applicants: Tingwu Song, Palos Verdes, CA (US); Paul T. Noonan, Boise, ID (US)

(72) Inventors: Tingwu Song, Palos Verdes, CA (US); Paul T. Noonan, Boise, ID (US)

(73) Assignee: Tingwu Song

( * ) Notice: Subject to any disclaimer, the term of this patent is extended or adjusted under 35 U.S.C. 154(b) by 0 days.

(21) Appl. No.: 15/940,599

(22) Filed: Mar. 29, 2018

(65) Prior Publication Data

US 2019/0301821 A1 Oct. 3, 2019

(51) Int. Cl.
*F41A 3/66* (2006.01)
*F41A 11/00* (2006.01)

(52) U.S. Cl.
CPC ..... *F41A 3/66* (2013.01); *F41A 11/00* (2013.01)

(58) Field of Classification Search
CPC .... F41A 3/64; F41A 3/66; F41A 11/00; F41A 11/02; F41A 3/78; F41C 23/00; F41C 23/06; F41C 23/10; F41C 23/16; F41C 23/20
See application file for complete search history.

(56) References Cited

U.S. PATENT DOCUMENTS 1,290,855 A * 1/1919 Wesson ..... F41A 3/64 42/69.02
3,342,171 A * 9/1967 Ryan ..... A63H 5/04 124/37
4,463,654 A * 8/1984 Barnes ..... F41A 19/09 42/74
4,596,084 A * 6/1986 Martial ..... F41A 3/66 42/75.03
4,601,123 A * 7/1986 Swearengen ..... F41A 11/02 42/70.01
4,663,876 A * 5/1987 Reaume ..... F41A 13/12 42/69.01
5,775,312 A * 7/1998 Wilkinson ..... F41B 11/642 124/67
8,584,574 B2 * 11/2013 Wosssner ..... F41A 3/66 42/75.1
8,789,305 B1 * 7/2014 DiChario ..... F41A 3/66 42/75.03
9,009,986 B1 * 4/2015 Chang ..... F41A 3/66 33/640
9,062,923 B1 * 6/2015 Thorup ..... F41A 3/64
9,115,954 B1 * 8/2015 Corsi ..... F41C 7/02
9,200,864 B2 * 12/2015 Lin ..... F41B 7/08
9,297,599 B2 * 3/2016 Underwood ..... F41A 3/66
9,459,060 B2 * 10/2016 Langevin ..... F41A 3/66
9,534,861 B1 * 1/2017 Kellgren ..... F41A 21/482
9,677,846 B1 * 6/2017 Vankeuren, III ..... F41C 23/20
10,184,738 B1 * 1/2019 Kellgren ..... F41A 3/66
10,260,829 B1 * 4/2019 Wright ..... F41A 11/02
2003/0140542 A1 * 7/2003 Kay ..... F41C 23/16 42/75.03
2003/0196366 A1 * 10/2003 Beretta ..... F41C 23/18 42/71.01

(Continued)

*Primary Examiner* — Derrick R Morgan

(57) ABSTRACT

A receiver and a method for manufacturing it are disclosed. The receiver contains a first panel, a second panel, and a buffer tube insert sandwiched between the first panel and the second panel.

12 Claims, 6 Drawing Sheets

(56) References Cited

U.S. PATENT DOCUMENTS

2006/0169268 A1* 8/2006 Tippmann, Jr. ..... F41B 11/62 124/80
2008/0216375 A1* 9/2008 Barrett ..... F41A 3/66 42/16
2008/0229642 A1* 9/2008 Hu ..... F41B 11/64 42/54
2009/0194088 A1* 8/2009 Tippmann, Jr. ..... F41A 11/00 124/74
2010/0162608 A1* 7/2010 McCann ..... F41C 23/14 42/71.01
2010/0224180 A1* 9/2010 Tippmann, Jr. ..... F41A 35/00 124/74
2010/0229445 A1* 9/2010 Patel ..... F41A 3/66 42/6
2011/0226227 A1* 9/2011 Douglas ..... F41B 11/57 124/77
2012/0055059 A1* 3/2012 Cauhape ..... F41C 23/04 42/71.01
2012/0060814 A1* 3/2012 Macy ..... F41B 11/62 124/73
2013/0091751 A1* 4/2013 Barney ..... F41C 23/10 42/71.01
2014/0091065 A1* 4/2014 Dumortier ..... F41A 3/66 219/72
2014/0237878 A1* 8/2014 Lambert ..... F41A 3/66 42/75.01
2014/0331535 A1* 11/2014 Robinson ..... F41A 3/66 42/6
2015/0000171 A1* 1/2015 Roberts ..... F41A 3/66 42/75.03
2015/0052794 A1* 2/2015 Underwood ..... F41A 3/66 42/16
2015/0300774 A1* 10/2015 Wheaton ..... F41C 23/12 42/72
2016/0033218 A1* 2/2016 Folkestad, II ..... F41A 3/66 89/194
2016/0033219 A1* 2/2016 Meier ..... F41A 3/66 89/191.01
2016/0341501 A1* 11/2016 Kokinis ..... F41A 5/26
2017/0072600 A1* 3/2017 Johnson, Jr. ..... B29C 39/10
2017/0131051 A1* 5/2017 Albury ..... F41A 11/00
2017/0205162 A1* 7/2017 Beaty ..... F41A 3/18
2017/0227309 A1* 8/2017 Faxon ..... F41A 11/00
2017/0299292 A1* 10/2017 Daley, Jr. ..... F41A 11/00
2017/0314880 A1* 11/2017 Dienno ..... F41A 11/00
2018/0003457 A1* 1/2018 McCallum ..... F41A 19/10
2019/0086168 A1* 3/2019 Song ..... F41A 3/66
2019/0212083 A1* 7/2019 Konev ..... F41A 5/26
2019/0249947 A1* 8/2019 Schroeder ..... F41C 23/10
2019/0285380 A1* 9/2019 Washburn, III ..... F41A 11/02
2019/0301821 A1* 10/2019 Song ..... F41A 3/66

* cited by examiner

FIREARM RECEIVER AND A METHOD OF MANUFACTURING IT

FIELD

The present invention relates to firearm manufacture. More particularly, the present invention relates to a firearm receiver and a method of manufacturing it.

BACKGROUND

Firearm receiver is a part of a firearm that provides housing for a hammer, a bolt and/or a firing mechanism. Unfinished receivers, also referred to as 80% receivers, are only about 80% completed. It is up to a customer to finish manufacturing a firearm by performing the remaining 20% of the drilling and/or milling. Due to complexities involved, many customers do not have the equipment and/or knowledge to properly manufacture the last 20% of the firearm receiver.

Therefore, there is a need for a firearm receiver and a method of manufacturing it such that a customer can easily finish manufacturing the last 20% of the firearm.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Figure 1:
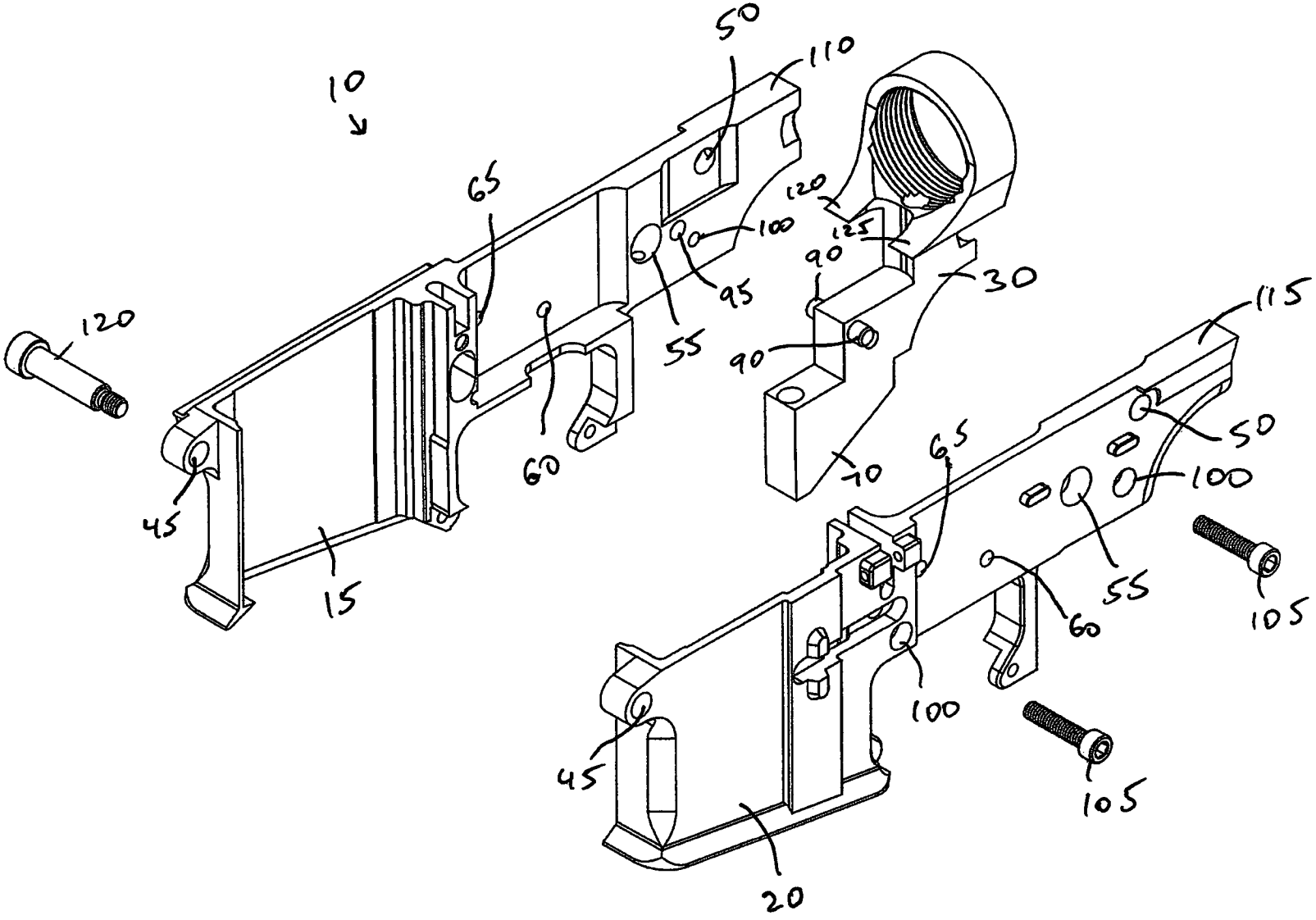
FIG. 1 depicts an exploded view of a receiver according to the present disclosure.
Figure 5:
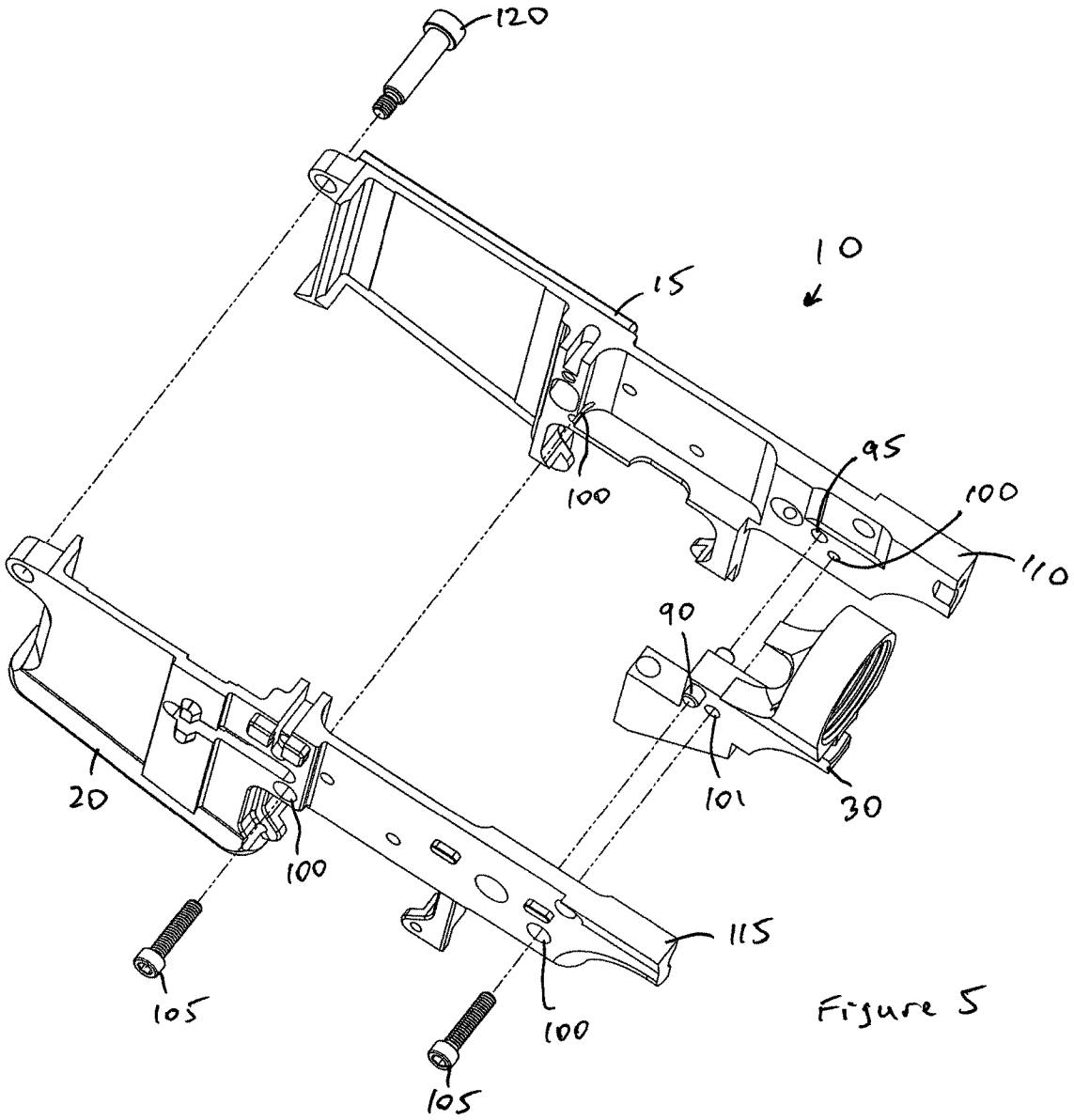
FIG. 5 depicts another exploded view of the receiver according to the present disclosure.
Figure 6:
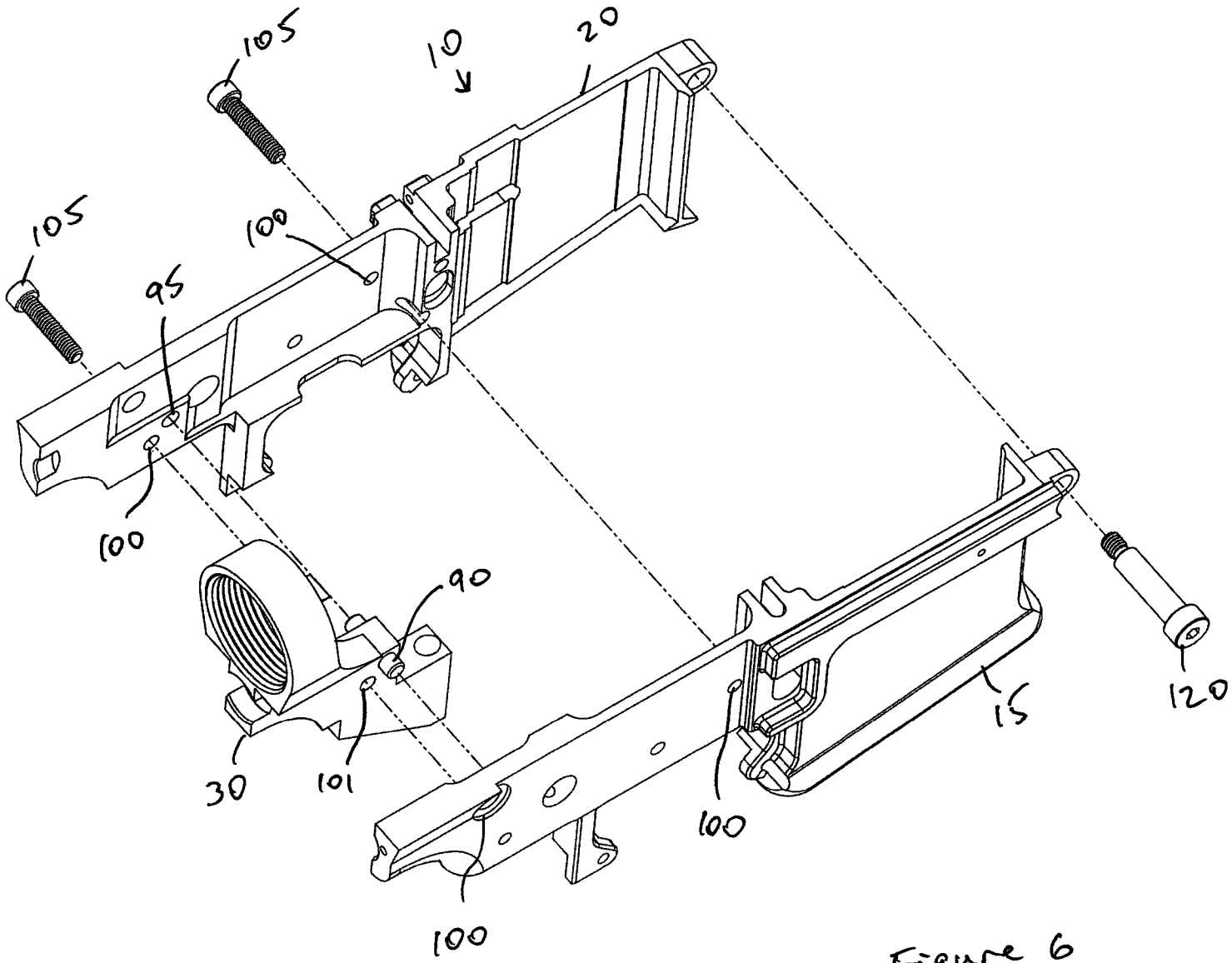
FIG. 6 depicts another exploded view of the receiver according to the present disclosure.

Referring to FIGS. 1 and 5-6, an exploded view of a receiver 10 for a firearm is shown according to the present disclosure. The receiver 10 comprises a first panel 15, a second panel 20, and a buffer tube insert 30. It is to be understood that the assembled receiver 10 may be an Armalite (AR) style lower receiver or any other type of a firearm receiver.

Figure 2:
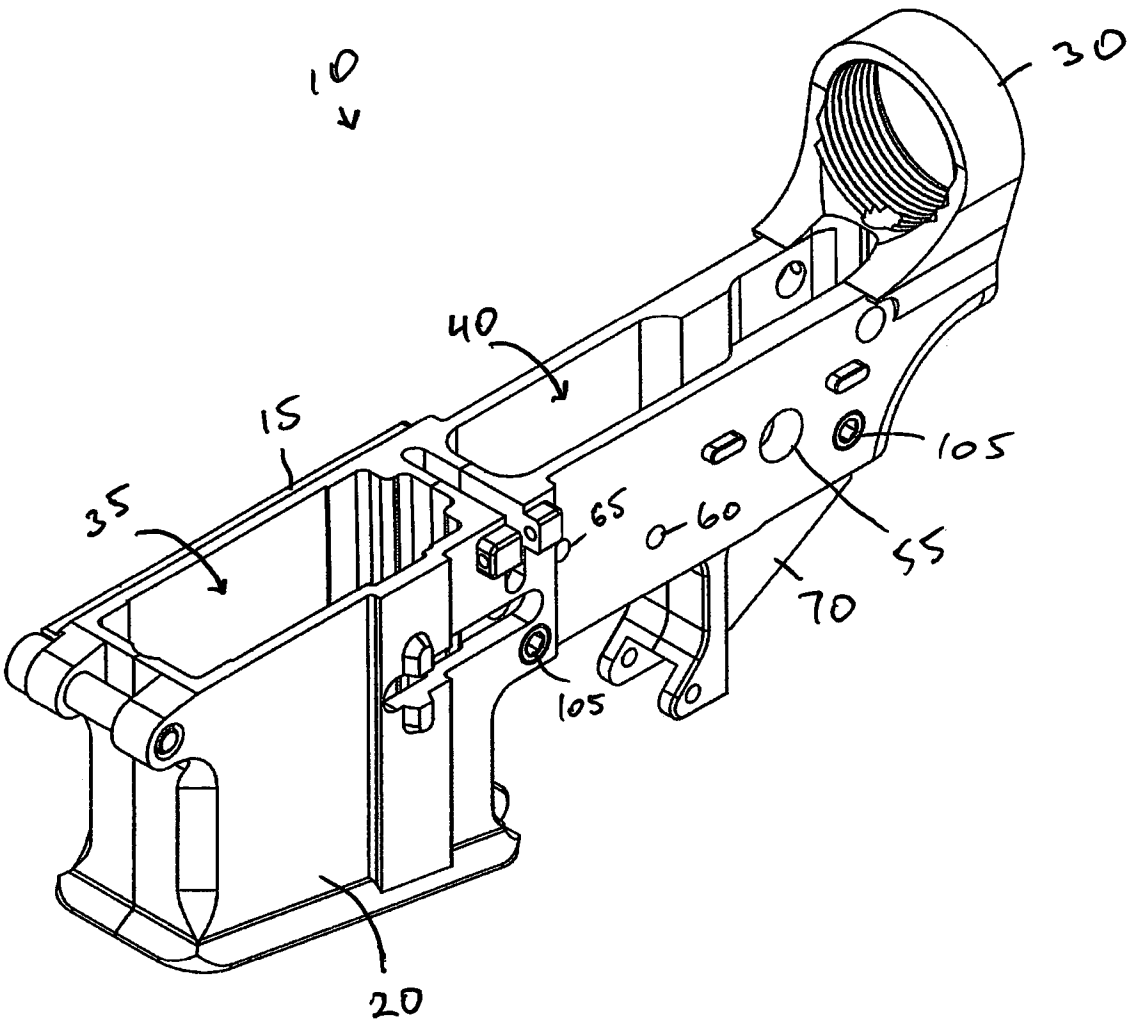
FIG. 2 depicts an assembled view of the receiver according to the present disclosure.
Figure 3:
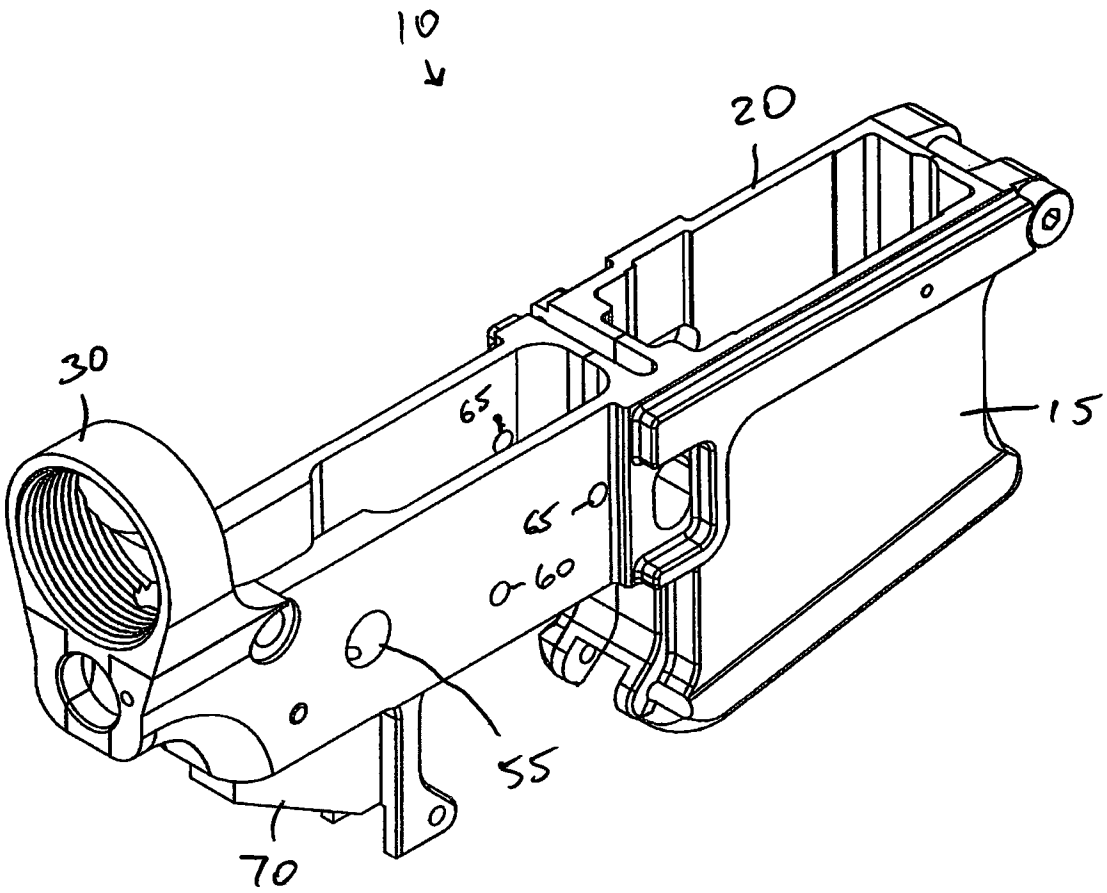
FIG. 3 depicts another assembled view of the receiver according to the present disclosure.

FIGS. 2-3 depict an assembled view of the receiver 10 according to the present disclosure. The assembled receiver 10 forms openings for accepting the internal mechanisms required to operate the firearm. For example, the assembled receiver 10 may comprise an opening 35 configured to accept an ammunition magazine (not shown) and associated hardware to direct rounds loaded within the magazine into a chamber in an upper receiver (not shown). The assembled receiver 10 may also comprise an opening 40 configured to accommodate a standard firing mechanism (i.e. standard trigger group). According to some embodiments, the standard firing mechanism (i.e. standard trigger group) comprises a trigger mechanism and a hammer mechanism.

According to some embodiments, the first panel 15 and the second panel 20 comprise through-holes 45 and 50 configured to align with a respective through-holes of an upper receiver (not shown) whereby a pin is inserted into and passes within each through-hole 45, 50 to secure the assembled receiver 10 with the upper receiver (not shown). According to some embodiments, the first panel 15 and the second panel 20 comprise safety-selector through-holes 55 whereby a pin is inserted into and passes within the safety-selector through-holes 55 to secure a safety selector mechanism inside the assembled receiver 10. According to some embodiments, the first panel 15 and the second panel 20 comprise trigger through-holes 60 whereby a pin is inserted into and passes within the trigger through-holes 60 to secure a trigger mechanism inside the assembled receiver 10. According to some embodiments, the first panel 15 and the second panel 20 comprise hammer through-holes 65 whereby a pin is inserted into and passes within the hammer through-holes 65 to secure a hammer mechanism inside the assembled receiver 10.

Figure 4:
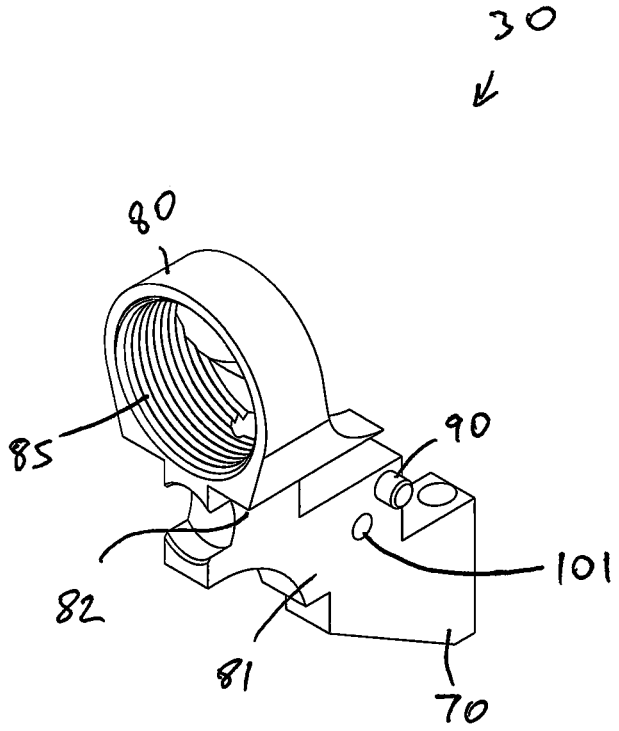
FIG. 4 depicts a buffer tube insert according to the present disclosure.

Referring to FIG. 4, a buffer tube insert 30 is shown according to the present disclosure. The buffer tube insert 30 comprises an upwardly extending lobe 80 and a support member 81. According to some embodiments, the upwardly extending lobe 80 is coupled with an upper portion 82 of the support member 81. According to some embodiments, the upwardly extending lobe 80 is integrally coupled with the upper portion 82 of the support member 81. According to some embodiments, a lower portion 70 of the support member 81 comprises a grip mounting surface for securing, for example, a grip (not shown). The grip may be a pistol grip. According to some embodiments, the support member 81 comprises one or more alignment protrusions 90.

According to some embodiments, the upwardly extending lobe 80 is used to mount a buttstock (not shown) to the assembled receiver 10 and is used to align a receiver extension (not shown) with a bolt carrier housed within an upper receiver (not shown). The receiver extension (not shown) generally houses an action (or recoil) spring and a buffer assembly (not shown). Upon discharge of a round, the bolt carrier within the upper housing is driven rearward by action of the gas discharged by the firing action. The buffer assembly and action spring dampen the kickback experienced by a user while also redirecting the firing mechanism back toward the chamber in preparation for firing another round. According to some embodiments, the upwardly extending lobe 80 comprises a generally circular threaded through-hole 85 adapted to receive the mating male threads on the receiver extension (not shown).

According to some embodiments, at least portion of the support member 81 is sandwiched between the first panel 15 and the second panel 20 to form the assembled receiver 10 as shown in FIGS. 2-3. According to some embodiments, the upwardly extending lobe 80 forms a generally 90 degree elbow with the first panel 15 and the second panel 20. According to some embodiments, the upwardly extending lobe 80 is substantially perpendicular to the first panel 15 and the second panel 20. The first panel 15 and the second panel 20 may comprise openings 95 configured to accommodate the alignment protrusions 90 of the support member 81.

According to some embodiments, the first panel 15 and the second panel 20 comprise one or more through openings 100 configured to accommodate one or more fasteners 105. The fasteners 105 may be screws, pins, socket head cap screws. The fasteners 105 are configured to couple the first panel 15 with the second panel 20.

According to some embodiments, the support member 81 comprises a through opening 101 configured to accommodate one of the fasteners 105. One of the fasteners 105 is configured to couple the support member 81 with the first panel 15 and the second panel 20 though the opening 101.

According to some embodiments, the first panel 15 comprises a generally flat top surface 110 (shown in FIG. 1). According to some embodiments, the second panel 20 comprises a generally flat top surface 115 (shown in FIG. 1). According to some embodiments, the upwardly extending lobe 80 comprises extending support surfaces 120 and 125 (shown in FIG. 1). The top surfaces 110 and 115 may be positioned to support the support surfaces 120, 125.

According to some embodiments presently disclosed, the first panel 15 and/or the second panel 20 comprise a first material having a first melting point and the buffer tube insert 30 comprises a second material having a second melting point.

According to some embodiments, the assembled receiver 10 may comprise a fastener 120 configured to couple the first panel 15 with the second panel 20 through the through-holes 45. The fastener 120 may also couple the assembled receiver 10 with an upper receiver (not shown).

According to some embodiments presently disclosed, the first material is steel, aluminum, metal, polymer, and/or sintered metal powder. According to some embodiments presently disclosed, the second material is steel, aluminum, metal, polymer, and/or sintered metal powder. According to some embodiments presently disclosed, the first melting point is lower than the second melting point.

According to some embodiments presently disclosed, the one or more through openings 100 are generally circular threaded through-holes adapted to receive the mating male threads on the one or more fasteners 105.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

What is claimed is:

1. A lower receiver comprising:
a first panel;
a second panel; and
a buffer tube insert sandwiched between the first panel and the second panel;
wherein the buffer tube insert comprises:
an upwardly extending lobe; and
a support member coupled with the upwardly extending lobe, wherein a lower portion of the support member comprises a grip mounting surface for securing a pistol grip with the lower receiver.

2. The lower receiver of claim 1, further comprising one or more fasteners coupling the first panel with the second panel.

3. The lower receiver of claim 2, wherein one of the one or more fasteners couples the first panel with the second panel through an opening in the buffer tube insert.

4. The lower receiver of claim 1, wherein the buffer tube insert comprises alignment protrusions.

5. The lower receiver of claim 4, wherein the first panel and the second panel comprise openings configured to accommodate the alignment protrusions.

6. The lower receiver of claim 1, wherein the first panel comprises a first through opening and the second panel comprises a second through opening.

7. The lower receiver of claim 6, further comprising a fastener coupling the first panel with the second panel through an opening in the buffer tube insert and through the first and second openings.

8. The lower receiver of claim 7, wherein the first panel comprises a first flat top surface above the first through opening and the second panel comprises a second flat top surface above the second through opening.

9. The lower receiver of claim 8, wherein an upwardly extending lobe comprises a first support surface and a second support surface, wherein the first flat top surface supports the first support surface and the second flat top surface supports the second support surface.

10. The lower receiver of claim 7, wherein the buffer tube insert comprises alignment protrusions.

11. The lower receiver of claim 10, wherein the first panel and the second panel comprise openings configured to accommodate the alignment protrusions.

12. The lower receiver of claim 11, wherein the opening in the buffer tube insert is positioned between the alignment protrusions and the upwardly extending lobe.

* * * * *